US009380397B2

(12) United States Patent
Kane et al.

(10) Patent No.: US 9,380,397 B2
(45) Date of Patent: Jun. 28, 2016

(54) SYSTEM AND METHOD FOR DETECTING AND ANALYZING NEAR RANGE WEAPON FIRE

(71) Applicant: Intrepid Networks, Clermont, FL (US)

(72) Inventors: Brittin Kane, Clermont, FL (US); Joshua Witter, Orlando, FL (US); Jim Schmorde, Eugene, OR (US); Joel Villa, Phoenix, AZ (US)

(73) Assignee: Intrepid Networks, LLC, Clermont, FL (US)

( * ) Notice: Subject to any disclaimer, the term of this patent is extended or adjusted under 35 U.S.C. 154(b) by 290 days.

(21) Appl. No.: 14/047,227

(22) Filed: Oct. 7, 2013

(65) Prior Publication Data

US 2016/0157032 A1 Jun. 2, 2016

Related U.S. Application Data

(60) Provisional application No. 61/724,048, filed on Nov. 8, 2012.

(51) Int. Cl.
*H04R 29/00* (2006.01)
*G08B 21/18* (2006.01)

(52) U.S. Cl.
CPC ..... *H04R 29/00* (2013.01); *G08B 21/18* (2013.01)

(58) Field of Classification Search
CPC ..... G01S 5/22; Y10S 367/906
See application file for complete search history.

(56) References Cited

U.S. PATENT DOCUMENTS 4,675,656 A 6/1987 Narcisse
4,785,291 A 11/1988 Hawthorne
H1916 H * 11/2000 Hollander ..... G01S 7/539 367/118
6,178,141 B1 * 1/2001 Duckworth ..... F41H 11/00 367/124
6,847,587 B2 * 1/2005 Patterson ..... F41H 11/00 367/127
7,474,208 B1 * 1/2009 Klein ..... G08B 21/24 340/384.4
7,855,935 B1 12/2010 Lauder et al.
8,018,334 B1 9/2011 DiMartino et al.
8,134,889 B1 * 3/2012 Showen ..... G01S 5/18 367/127
8,351,297 B2 * 1/2013 Lauder ..... G01S 3/80 367/128
8,937,545 B2 * 1/2015 Kane ..... G06Q 10/10 340/539.11
9,047,749 B2 * 6/2015 Kane ..... G08B 21/0247
2004/0100868 A1 * 5/2004 Patterson, Jr. ..... F41H 11/00 367/127
2005/0057359 A1 3/2005 Coffey
2008/0008044 A1 * 1/2008 Patterson ..... G01S 5/22 367/128
2008/0101329 A1 5/2008 Richards
2008/0143582 A1 6/2008 Park et al.
2008/0174492 A1 7/2008 Kurokawa (Continued)

OTHER PUBLICATIONS

Kleinsmith, "Gunshot Detection Application for Mobile Phones" University of the Western Cape 2010, Sep. 2010, p. 1-20.

(Continued)

*Primary Examiner* — Daniel Pihulic
(74) *Attorney, Agent, or Firm* — Ferdinand M. Romano; Beusse Wolter Sanks & Maire, PLLC

(57) ABSTRACT

A method for identifying a gunshot occurrence. According to one embodiment, microphone data and inertial motion data are acquired with a hand-held device. Based on an acoustic criterion, a determination is made as to whether a gunshot has been produced. Based on a correlation criterion applied to the inertial motion data, a determination is made as to whether the gunshot was produced from fire produced by a first person having physical possession of the hand-held device or by a second person spaced away from the first person.

14 Claims, 7 Drawing Sheets

(56) References Cited

U.S. PATENT DOCUMENTS

| | | | | |
|---|---|---|---|---|
| 2011/0169633 | A1* | 7/2011 | Lauder | G01S 5/18 340/539.13 |
| 2012/0087212 | A1* | 4/2012 | Vartanian | G01S 15/08 367/118 |

OTHER PUBLICATIONS

Dragon Force, Fight Smarter, http://www.drakontas.com/, p. 1-2.
GeoSuite, Beacause Every Second Counts, http://www.gdc4s.com/geosuite?taxonomyCat=131, p. 1-2.

* cited by examiner

SYSTEM AND METHOD FOR DETECTING AND ANALYZING NEAR RANGE WEAPON FIRE

RELATED APPLICATIONS

This application is a United States Non-Provisional Patent Application which claims priority to U.S. Provisional Patent Application No. 61/724,048 filed Nov. 8, 2012. This application is related to U.S. Non-Provisional patent application Ser. No. 14/047,273 filed on Oct. 7, 2013. This application is also related to the following United States Non-Provisional Patent Applications: Ser. No. 13/671,961 filed Nov. 8, 2012; Ser. No. 13/672,017 filed Nov. 8, 2012; Ser. No. 13/672,105 filed Nov. 8, 2012; and Ser. No. 13/672,167 filed Nov. 8, 2012.

FIELD OF THE INVENTION

The present invention relates to detection and discrimination of gun fire relative to other acoustic signals and, in one series of embodiments, to identifying occurrences of gunfire in close range of persons possessing hand-held devices or gunfire from an individual possessing the hand-held device.

BACKGROUND

It is recognized that the location of gunfire is discernible with, for example, triangulation systems which incorporate acoustic sensing equipment. Such known systems are stationary and may be installed in large outdoor environments to improve public safety by providing rapid notifications which alert officials of a gun fire incident in a determined location. U.S. Pat. No. 7,855,935 discloses identification of mobile communications devices within a specified range of distance from a determined location of a gun firing. Identification may be followed by communication with such devices in order to acquire information relating to the incident with potentially knowledgeable persons. Such systems are useful surveillance tools, especially when monitoring large areas that cannot be comprehensively patrolled by law enforcement or security personnel.

Yet it is often desirable to reliably obtain further details of incidents in a rapid and automated manner, particularly when the incident occurs in the presence of security personnel. Persons working in the fields of law enforcement, military activities and security operations are often engaged in patrol activities and other endeavors during which gun fire may occur without warning. Often, in performing routine duties such as monitoring of assigned areas, personnel travel over relatively large geographic areas while not in continuous communications with a command and control center. Consequently, if personnel have an encounter involving gunfire, communication of such an occurrence may not be immediate or timely. There is also a possibility that personnel present may become impaired as a result of the gunfire, rendering it less likely that the incident can be quickly reported. It is therefore desirable to provide a methodology that results in a more timely and informative notice of gunfire, whether originating from a firearm in the possession of the personnel, or from another person possessing a firearm in close proximity of the personnel, with reliable information about the nature and extent of the gunfire incident.

SUMMARY OF THE INVENTION

According to one embodiment of the invention, a method is provided for detecting weapon fire with a hand-held device of the type having a microphone capable of detecting acoustic energy present at the hand-held device. The hand-held device includes capability of recording acoustic energy, i.e., detected by the microphone. The method includes using the microphone to continually generate a time series of acoustic voltage signals indicative of temporally varying sound pressure levels at the hand-held device. The acoustic voltage signals are analyzed to identify an event for which voltage for the sound pressure level exceeds a predetermined threshold value. For an identified event, the acoustic voltage signals, received from the microphone during a first time period, are recorded on a non-transitory computer readable storage medium. The method includes determining a first set of correlations between characteristics of the recorded acoustic voltage signals and prior known information characteristic of a gun fire event, and determining whether the event is a gun fire event based on whether, for at least one type of correlation in the first set, the determined correlation meets or exceeds a threshold correlation value assigned to the correlation type. When the determined correlation meets or exceeds the threshold correlation value, a determination is provided as to whether the event was a gun fire event. For a determination that the event was a gun fire event, information based on the determination is provided to a display screen to provide notification based on the determination.

According to another embodiment of the invention, a method is provided for identifying or analyzing signals to determine occurrences of gun fire. The method includes acquiring time varying acoustic data with a microphone coupled to a hand-held device, and storing the acoustic data in a non-transitory computer readable storage medium. Information indicative of acoustic energy levels associated with the acquired data is provided. A signal strength criterion is also provided based on a predetermined threshold acoustic energy level and weapon fire criteria are provided for establishing an inference that the acquired data is generated by weapon fire. The signal strength criterion is applied to determine whether the time varying data is based on a signal strength having a predetermined threshold acoustic energy level. When it is determined that the time varying data is based on the predetermined threshold acoustic energy level, the weapon fire criteria are applied to determine whether the acquired data is generated by weapon fire.

A method is also provided for identifying a gunshot occurrence with a mobile hand-held device. According to one embodiment, microphone data are acquired with the hand-held device and inertial motion data are acquired with the hand-held device during a portion of the time period in which the microphone data is acquired. Based on an acoustic criterion, a determination is made as to whether a gunshot has been produced. Based on a correlation criterion applied to the inertial motion data, a determination is made as to whether the gunshot was produced from fire produced by a first person having physical possession of the hand-held device or by a second person spaced away from the first person.

A computer-implemented method for monitoring whether a person in possession of a first hand-held communications device is in the presence of weapon fire includes receiving, into a non-transitory computer readable storage medium, via a wireless network, information derived from measured acoustic data acquired with a microphone connected to the first hand-held device. The information is useful for providing an indication of whether an acoustic event is the result of weapon fire within at least ten meters of the hand-held device.

A method of determining whether an officer present during a weapon fire incident is out of ammunition, or how much ammunition is left, includes acquiring microphone data during weapon firings with a hand-held communication device having a wireless network connection and acquiring inertial data during the weapon firings with the hand-held communication device. The microphone data and the inertial data are stored in a non-transitory computer readable storage medium. A microprocessor determines from the inertial data whether each in a plurality of gunshots has been produced from fire produced by a first person in possession of the hand-held device or by one or more other persons spaced away from the hand-held device. The number of weapon firings produced by the first person is counted.

According to still another embodiment, a method is provided for identifying a gunshot occurrence with a hand-held communication device. The method includes performing automatic microphone recording of data with a hand-held communication device upon detection of a signal having a predetermined sound level. The data are analyzed with a processor running on the hand-held device to determine whether the signal having the predetermined sound level has been produced from gun fire. Information is provided to a computer system via a wireless network based on whether the signal having the predetermined sound level has been produced from gun fire.

In still another embodiment, a method is provided for detecting weapon fire with a hand-held device of the type having a microphone capable of detecting acoustic energy present at the hand-held device. The hand-held device includes capability of recording acoustic energy (i.e., sound energy) detected by the microphone. The hand-held device includes one or more second sensors for detecting inertial movement of the hand-held device and also includes capability of recording data associated with detected inertial movement. According to the method, a microphone continually generates a first time series of acoustic voltage signals indicative of temporally varying sound pressure levels at the hand-held device. The second sensors continually generate a second time series of voltage signals indicative of temporally varying inertial movement of the hand-held device. Signals in the first series are analyzed to identify an event for which voltage for the sound pressure level exceeds a predetermined threshold value. The method includes determining a first set of correlations between signals in the first series and information characteristic of gunfire, and a threshold correlation value is associated with each correlation in the first set. A second set of correlations is determined between signals in the first set and signals in the second set. A threshold correlation value is associated with each correlation in the second set. When at least one of the correlations of the first set exceeds the associated threshold correlation value, information is sent from the hand-held device via the network indicating there has been an occurrence of gun fire. When at least one of the correlations of the second set exceeds the associated threshold correlation value, information is sent via the network that a weapon which created the occurrence of gun fire has been fired by a person having possession of the hand-held device.

The invention is useful in contexts where it is desirable to quickly determine that gunfire has occurred in the presence of personnel and to provide notice regarding the nature and extent of the gunfire. This information, for example, can be used to stimulate an optimum response when deploying other personnel to the location of the gunfire. The personnel may be employees of a law enforcement operation, military personnel or members of a private security operation. In one series of embodiments, the invention makes use of a hand-held communication device that, for example, may be a mobile telephone or a tablet computer, having a communication link with a server via a cellular network. The server receives information from each of multiple personnel in an operation.

A feature of the invention is that determination of whether a gunshot has occurred can be primarily based on detection and analysis of a close range acoustic or recoil energy source. In this context, a recoil energy source is a weapon that imparts momentum to a person holding the weapon upon firing. Weapon fire near a hand-held device can be confirmed by detection of a minimum level acoustic or recoil energy signal resulting from the weapon fire followed by application of correlation or other characterization techniques. One method according to the invention can determine weapon fire when a weapon is fired within ten meters of a person holding a telephone. Limiting the method to such close range detection may be preferred in order to assure that a microphone on the hand-held device receives a signal level of sufficient magnitude to be distinguished from other less relevant sounds. Another method according to the invention determines if the individual in possession of the hand held device has fired the weapon by monitoring output from an accelerometer within the hand held device to detect recoil events.

In one exemplary method, a Gun Shot Detection application runs on a mobile telephone and actively engages microphone or accelerometer circuitry during periods when the mobile telephone is not in use for voice communication. The application powers up at least a primary microphone or accelerometer and associated circuitry to continuously process audio or recoil energy signals received by the sensor in order to determine and compare signal levels. Whenever the received signal level exceeds a predetermined upper threshold value, e.g., 120 dB for an audio signal, digital recording of the signal is initiated. The data acquisition may be at the maximum rate achievable with existing processing circuitry of the telephone, e.g., on the order of fifty samples per second. The recording of signal levels ceases (i) after expiration of a predetermined time period, e.g., three to ten seconds, or (ii) after occurrence of a decay in the signal level below a predetermined lower threshold value.

In a relatively simple implementation of the method, the recording begins after the signal strength exceeds the predetermined level. The time varying signal level is then compared with one or more decay patterns of known gunshot signals for audio or recoil energy. Based on this comparison, a determination is made as to whether the measured signal results from a gun firing. By way of example, the determination may be based on direct comparison (e.g., feature by feature) between temporal characteristics of the recorded signal and audio or recoil energy patterns characteristic of gun shots. In other embodiments the comparison may be based on computed correlation between the measured time varying signal level and each of one or more known audio or recoil energy patterns to determine whether at least one correlation meets or exceeds a predetermined minimum level of confidence. A threshold correlation value can be chosen for each correlation to provide a relatively high level of confidence that incorrect determinations, i.e., false positive results, are relatively unlikely, e.g., having a probability less than ninety percent. Incorrect determinations could result from other events such as explosion of fireworks or operation of jackhammers. By performing multiple correlations and requiring that multiple correlations meet or exceed threshold values, false positives can be avoided.

Once a determination is made that a gunshot has occurred, the application running on the mobile telephone which detected the gun shot communicates the positive determination via the cellular network to a Gun Shot Alert application running on a server. The communication event can be a notification of a gunshot occurrence or a more specific notification, i.e., that the individual holding the portable wireless device has fired the weapon. The number of gunshots fired can also be determined and counts can be associated with the individual holding the portable wireless device and/or with one or more other individuals. The Gun Shot Alert application running on the server then generates a cancelable alert that is immediately forwarded through the network to telephones and other client devices in the possession of other personnel in the operation. The alert is created with regard to the officer in possession of the telephone which has automatically communicated the positive determination of a gun fire occurrence. It can be sent to all devices having a network connection to the server. The alert may also be presented as a notice on a monitor in a command center for the operation.

The alert may be canceled by subsequent communication from the telephone that made the detection, or by authorized personnel at the command center. Select other telephones may also have authority to cancel the alert. After a mobile telephone communicates to the server that a gunshot has been detected, the microphone or accelerometer can continue recording evidentiary audio and recoil/acceleration information for an appropriate time period following the event for post review. In one embodiment, the telephone or other hand-held device includes a removable memory card on which the evidentiary information is recorded and from which the recording cannot be easily erased by the user of the device. This evidentiary information may be automatically uploaded to the server for preservation and immediate or future review by personnel at the operation command center. Immediate uploading of evidentiary information reduces risk of tampering with or destructive efforts toward the recorded information, e.g., undertaken by assailants who might take control of the cell phone. The Gun Shot Detection application running on the mobile telephone also may automatically turn on video recording features of the telephone and store or upload that evidentiary information as well. The hand-held device may utilize a built-in camera for this purpose, but the camera would have to be positioned to capture useful video information. If the hand-held device is being carried in a pocket or in a case, one or more cameras can be positioned on the person's clothing to provide different views of the surrounding area. Each of the cameras may have a wired or a wireless connection to the hand-held device to provide single, multi-channel or multiplexed recording.

The Gun Shot Detection application may run on a mobile telephone of the type that includes accelerometers or other inertial sensors as part of an internal sensor structure, e.g., to modify the orientation of a screen display. When identifying weapon fire with only an acoustic microphone, it is not always possible to determine whether the firing is made by the person having possession of the telephone or by a nearby person holding the weapon. Another feature of the invention is based on recognition that when the telephone is coupled to the body of a person firing a weapon, the accelerometers can be applied to sense or measure forces associated with ballistic phenomena. The forces transferred through the body of the person firing the weapon can be sensed by accelerometers in a hand-held device.

Accelerometers resident in mobile telephones can be used to acquire and store data in conjunction with acquisition and storage of audio information. The combination of audio and inertial force information can be used to determine when a gunshot has been fired by an employee of the operation. This is because the force of a bullet being fired from a gun normally results in abrupt movement of the weapon. To the extent this movement is transferred to the human body holding the hand-held device, the movement can be sensed by an accelerometer or other device capable of measuring change in momentum. The number of bullets fired can also be determined from the number of determined threshold correlation values identified. In turn, this information can be used to determine the amount of ammunition left for personnel to continue weapon firing.

Thus, when the mobile telephone is equipped with an accelerometer, the Gun Shot Detection application running on the telephone places both the telephone microphone and one or more telephone accelerometers in an active mode to sense data. Circuitry in the telephone detects whether there is a simultaneous occurrence of both the threshold audio signal level received through the microphone and a threshold change in momentum as sensed by one or more accelerometers. Thus, when correlation between the received audio signal and a known decay pattern of a gunshot meets or exceeds a minimum level of confidence, there can also be a further determination that a weapon was fired by the officer, i.e., by the person holding the mobile telephone.

Movement sensed at the time of receiving the threshold audio signal level can further increase confidence that the audio signal is a result of weapon fire and not some other phenomenon such as thunder or an explosion. Thus analysis of accelerometer data in conjunction with analysis of acoustic data can differentiate between active firing of a pistol by an officer holding the telephone and the firing of a weapon by another person in close proximity to the officer.

Based on the foregoing, either or both the Gun Shot Detection application and the Gun Shot Alert application can separately count the number of bullets fired by the officer at any given time and as the number of bullets fired by other persons in close range of the officer. With knowledge of the number of bullets the officer has fired, and knowledge of the weapon and amount of ammunition assigned to the officer, it is possible to determine how much ammunition the officer has remaining in the weapon without reloading the weapon and the net amount of ammunition carried by the officer after several weapon firings. With knowledge of whether or not the officer is firing a weapon, the alert may state "Officer Shooting" or "Officer Detects Bullets".

When multiple bullets are fired over an extended period of time, a counter in the Gun Shot Detection application, running on the telephone which makes the gun fire detections, tracks the number of shots made by the officer holding the telephone and the number of other shots detected. With this information being provided to the Gun Shot Alert application running on the server, the alerts can be updated. For example, an alert "Officer fired three bullets" or "Officer detects five bullets" can replace an earlier version of an alert. An alert may also indicate how much ammunition is remaining in the weapon. Thus the command operation 6 can be informed whether the officer has run out of ammunition. While this may be of lesser importance for patrol officers who might rarely fire more than a few bullets in any incident, this capability is of greater importance for members of a SWAT (Special Weapons and Tactics) team or a military operation which needs to monitor ammunition usage with greater concern.

When multiple officers, each carrying a mobile telephone with the Gun Shot Detection application running on the telephone, are in close proximity of one another and each application detects the same audio sound, the data from the multiple sources can be used to further correlate the audio information and reduce false alarms by increasing levels of confidence. For example, correlation information may be based on a combination of accelerometer and audio information to determine with a high level of certainty who has fired a bullet, e.g., either an identifiable officer or another individual. The credibility of this information in an evidentiary proceeding is improved when multiple hand-held devices provide consistent and concurring information. The same or similar information may be used to improve the level of confidence in determining the actual position of weapon fire based on triangulation and using multiple hand-held devices.

According to several embodiments, hand-held devices running the Gun Shot Detection application do not record the microphone or accelerometer data until there is an event which may be a gun shot. Without recording data, microphone and accelerometer circuitry is powered on to detect acoustic levels which might correspond to gun fire in close proximity. Thus the device is used to continuously monitor for occurrence of an acoustic signal which generates a microphone voltage at a certain voltage level. Upon making this determination, the recording of microphone data begins in order to compare the decay pattern of the detected signal with known decay characteristics of gun fire waveforms. Alternately, it is possible to continuously capture windows of data having limited time duration in order to reconstruct a more complete time history of a gunshot wave form.

BRIEF DESCRIPTION OF THE DRAWINGS

These and other features, aspects, and advantages of the present invention will become better understood when the following detailed description is read with reference to the accompanying drawings in which like characters represent like parts throughout, and wherein.

In accord with common practice, the various described features are not drawn to scale, but are drawn to emphasize specific features relevant to the invention.

DETAILED DESCRIPTION OF THE INVENTION

The described examples illustrate numerous features according to embodiments of the invention, but the invention is not so limited. Methods and systems are provided for identification of gun firing incidents using hand held devices such as mobile telephones as audio receivers. The devices are capable of automatically generating and sending alerts to personnel at command centers and other locations to generate rapid responses and coordinate responses among personnel located at multiple locations. Because gun shots may be the second most common cause of mortality in law enforcement operations, embodiments of the invention are described which can be readily deployed in state and local law enforcement organizations. For example, embodiments enable determinations as to whether a gunshot is the result of firing a weapon by an officer or has been produced by firing of a weapon by someone other than the officer. It is also useful to determine with reliability the number of rounds of ammunition fired from the officer's weapon. This information contributes to improved situational awareness and can lead to indications such as whether the officer is about to run out of ammunition or needs to reload a weapon. Automated alerts can provide other officers and the command center with location information for the incident based on data communicated from the same hand-held device which automatically generates the alert. Information concerning the gun fire incident can be displayed in the form of a critical alert, in conjunction with location information on maps which are displayable on like hand-held devices in the possession of multiple law enforcement personnel. The law enforcement operation may automatically receive a recording of all events occurring shortly after the gunfire, such as may be automatically made by the same hand-held device which generates the alert. The recording may, for example, be used in a post incident review of the situation as objective evidence, analogous to utilizing information recorded in a "black box" after an aircraft incident.

Figure 1:
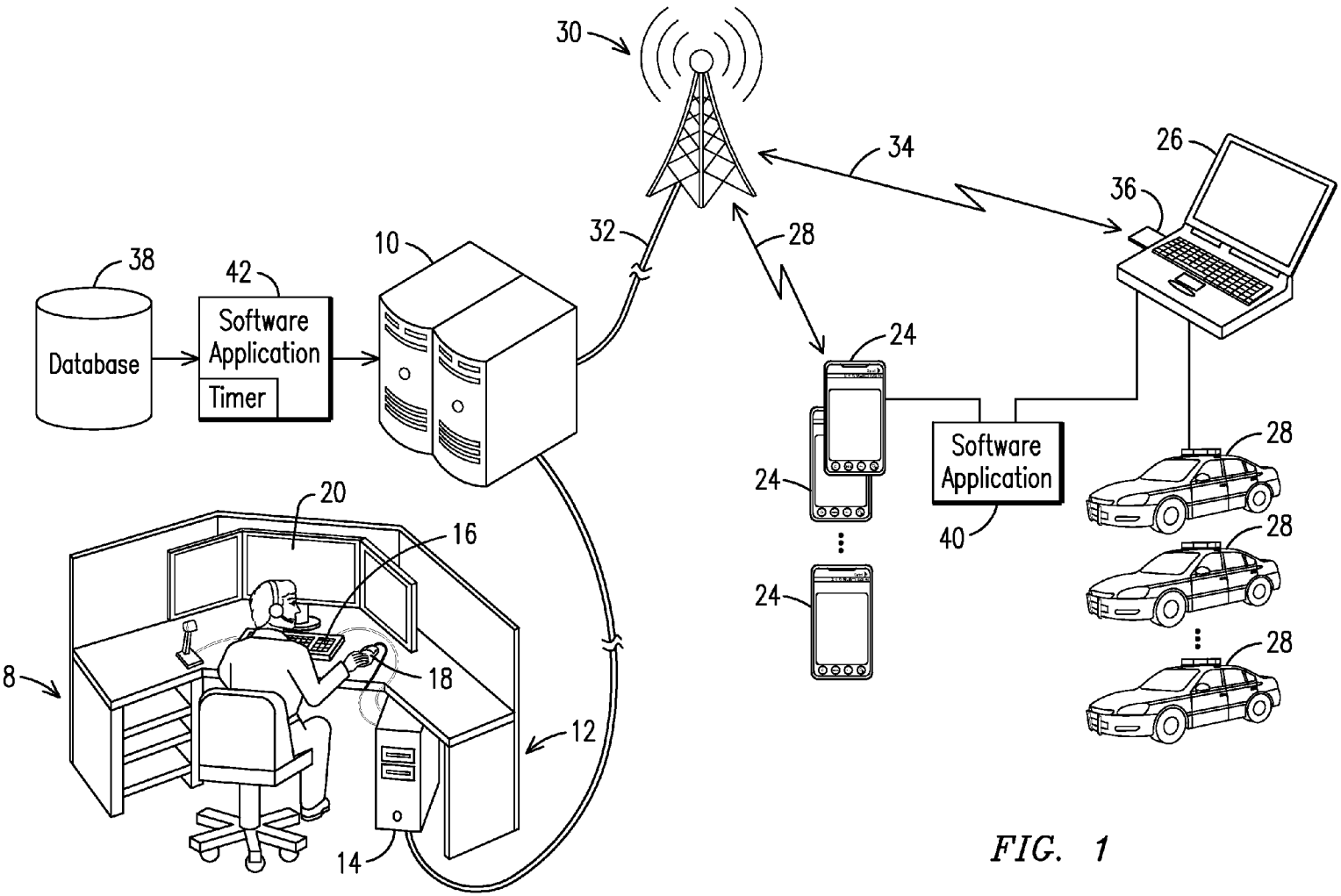
FIG. 1 illustrates select features of a command center network which supports gunshot detection in a law enforcement operation.

FIG. 1 illustrates select features of a command center network 4 which supports gunshot detection in a law enforcement operation 6 which can be used to improve situational awareness of deployed personnel according to the invention. In this example, the deployed personnel may be officers on patrol in a police department. The operation includes a command center 8 connected to a server 10. The command center 8 comprises an operator console 12 at which is located a computer 14 or a network terminal which includes conventional human machine interfaces, e.g., a keyboard 16, a mouse 18 and a monitor display 20. The server 10 and the computer 14 are part of the command center network 4, having connectivity between the server 10, the computer 14 or network terminal and numerous other communications devices, including hand held devices 24 (e.g., mobile telephones or tablet computers) in the possession of officers on patrol, and notebook computers 26 mounted in patrol vehicles 28 assigned to officers on duty. The server is a computer system comprising a processor, memory and storage media. As further described herein, the storage media contains a database which is accessed and modified with an application running on the server to perform analyses and to store and update information.

As shown for the embodiment of FIG. 1, the operation 6 has multiple assets deployed outside the command center to perform typical field activities of a local police department. Physical assets include an array of hand-held devices, which for the illustrated embodiments are the mobile telephones 24, each assigned to an officer on duty, and multiple patrol cars 28 in which the notebook computers are mounted. More generally, the hand-held devices may be processor based communications devices, including devices commonly referred to as tablet PCs or tablet computers, capable of data communications with a server via a WiFi link or a cellular data link. For the disclosed embodiments the mobile telephones 24 or other hand-held devices operate on a common cellular network with conventional rf links 28 to commercial cell towers and base stations. Voice communications capability is desirable but not required on the hand-held devices. It is noted that other embodiments contemplate personnel having both a telephone 24 for voice communications and a second hand-held device capable of wireless data communication for identifying and sending alerts regarding gun fire events.

An icon 30, illustrated as a tower in FIG. 1, is representative of a complete cellular network, comprising a plurality of towers and base stations through which communications are exchanged among the plurality of mobile telephones 24 and with personnel at the command center 8. Communications are exchanged between individual telephones 24 and the server 10 through the cellular network 30. To effect these communications the server 10 has a network connection 32 through which communications are sent or received via the base stations and towers. The network connection 32 also effects communications between the computer 14 at the command center 8 and the server 10 which may be remote from the computer 14. For example, the server 10 may operate at a location distant from the physical assets belonging to the law enforcement operation 6 and be made available by an independent provider of services to the law enforcement operation 6 on a shared basis with other clients, e.g., other law enforcement operations. In other embodiments, the server 10 may be an asset internal to the law enforcement operation 6 and connected to the computer 14 on an internal network.

The command center 8 and the officers performing field activities (e.g., patrolling or responding to emergency calls) may rely upon multiple modes of communication to coordinate activities and information. Possible modes include conventional police band radios, the mobile telephones 24 and, for officers assigned to patrol cars 28, notebook computers 26 mounted in the patrol cars 28. In the illustrated embodiment, the notebook computers 26 are each connected to the server 10 via a wireless communications link 34 to the base stations and towers of the cellular network 30. The wireless links 34 may be provided with conventional wireless modem cards 36.

Generally, it is desirable to provide methods which utilize these existing law enforcement resources to improve the situational awareness of the officers performing the field activities. To this end, the mobile telephones 24 are client devices with respect to the server 10, each running applications which communicate with the other to support detection and analysis of gun firings and promulgation of alerts when such weapon fire has occurred in close range (e.g., within five meters) of one of the telephones 24. The telephones 24 each run a Gun Shot Detection application 40 and the server 10 runs a Gun Shot Alert application 42. The applications 40 each include a communications interface for transferring information to one another.

In the following examples client devices, e.g., the telephones 24, running the Gun Shot Detection application 40, are each enabled to automatically provide event information to the server 10. As one example, the client device may provide information to, or may request information from, the server by generating a Java request object. When sending event information, such as correlation results or recorded audio information, the client device adds the information to the object, serializes the request object (i.e., the request object undergoes Java object serialization) and sends it to the server. Upon receipt, the server deserializes the data and stores the information in a database 38. The server 10 then sends an empty Java response object to the client device. Upon receipt of the response object the client device closes the HTTP connection with the server.

As is common for many mobile telephones, client devices used according to the invention may include multiple microphones, e.g., often three microphones. By simultaneously receiving audio signals through several microphones, it is possible to discriminate a signal from background noise by performing noise cancellation. A first microphone through which a user speaks to communicate is positioned to receive relatively strong speech signals which are typically encoded and transmitted for voice communications. On the other hand, background noise may be received at approximately the same level by the first microphone as well as a second or even a third microphone connected to the mobile telephone 24. Audio processing performed prior to encoding can improve the signal-to-noise ratio of the speech signals by subtracting the background noise, present in signals generated by the second or third microphone, from the acoustic voltage signals generated by the first microphone.

Advantageous features of embodiments of the invention are based, in part, on recognition that acoustic energy associated with a gunshot, which might otherwise be treated as background noise, are not be removed by processing methods applied to improve the quality of a voice signal in a hand-held device. When acquiring microphone data using circuitry of the telephone 24 to detect weapon fire, noise reduction circuitry can be disabled so that the audio signal being analyzed to detect the gunfire includes most or all audio information found in unprocessed data. This is desirable, whether the audio data to be analyzed is received from one microphone or multiple microphones of the hand-held device, to provide a more realistic depiction of the acoustic events analyzed to detect weapon fire. For these reasons, especially when the telephone includes multiple microphones, the application 40 initially modifies default settings on the telephone to prevent subtraction of background noise. However, disabling noise reduction circuitry or other forms of filtering normally used for the purpose of reducing noise during voice communication—in order to better capture features of an acoustic signal, does not preclude later use of filtering or other processing techniques to analyze a signal or prior to performing correlations.

The subroutines shown in FIGS. 2 and 3 illustrate functionality while actual implementations will vary. Examples assume multiple officers are simultaneously logged into hand-held client devices, e.g., telephones 24, and the applications 40 are continuously running on the client devices possessed by each officer while the application 42 is running on the server 10. With reference to FIG. 2A, a process for monitoring sound and detecting a gun fire incident is initiated in each mobile client device with an officer performing a secure login process as summarized in subroutine 210. Each officer uses an assigned client device (e.g., a telephone 24 or other hand-held device) to simultaneously log into both the client device and the server 10 via the network 4 to access the applications 40 and 42.

Once the officer is logged into the network server 10, multiple client functions are initiated on the client device in cooperation or coordination with functions running in the server application 42. Subroutines shown in FIGS. 2 and 3 are exemplary of functionality implemented by the applications 40 and 42.

Figure 2A:
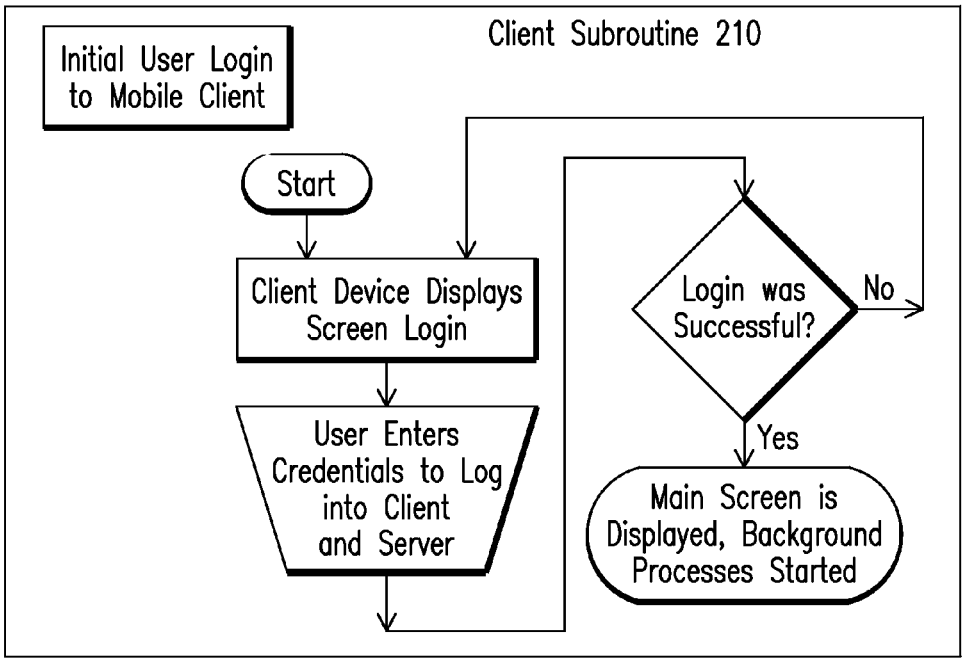
FIG. 2A illustrates a secure login process in one of a plurality of mobile client devices to initiate a subroutine for monitoring sound and detecting a gun fire incident.
Figure 2B:
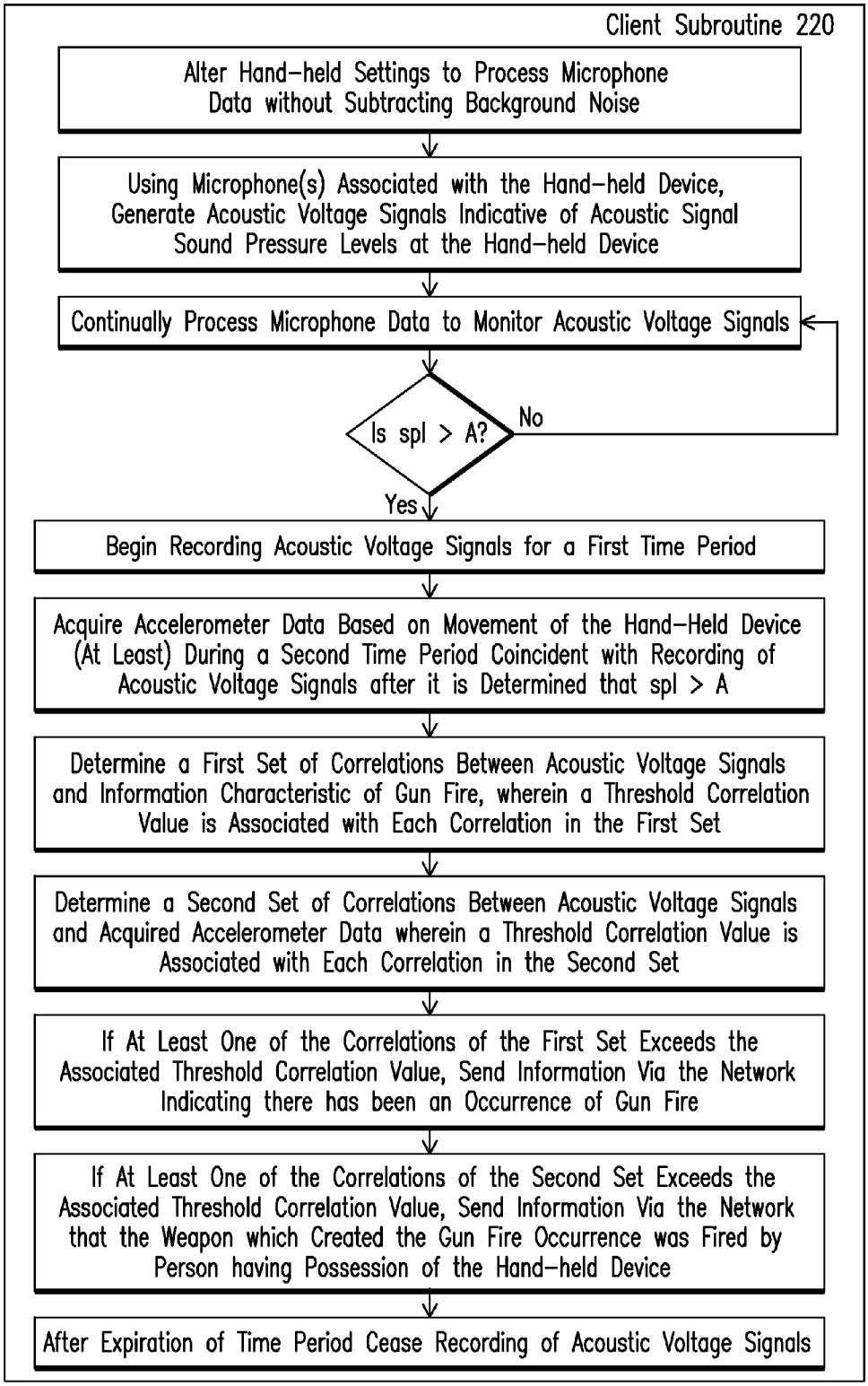
FIG. 2B illustrates a sound monitoring subroutine which runs on a client device to continually control measurement of sound levels, analyze and report out information.

Client subroutine 220 of the application 40, shown in FIG. 2B, is a sound monitoring application which runs on the client device to continually measure sound levels received with one or more microphones on, for example, the telephone 24. The subroutine 220 controls, analyzes and reports out to the server 10 results from ongoing collection of acoustic data during periods when the telephone 24 is not engaged in voice communications. To detect an acoustic signal which may result from a gun fire event, acoustic data is acquired with one or more microphones of the telephone 24 after the settings on the telephone 24 are altered so that the microphone data can be processed without first subtracting out background noise. However, if a call is initiated or received on the telephone 24 while the application 40 is running, the telephone processor may automatically suspend acquisition of acoustic data until the call is terminated or, in some embodiments, monitoring can continue while a call is in process. During periods when the call is in process, the telephone reverts to settings which subtract background noise to enhance the quality of voice communications during the call. When the call in process is terminated, the application again automatically alters the settings so that background noise is no longer subtracted from microphone data and ongoing analysis of acoustic data resumes.

Accordingly, after the hand-held settings are altered to process microphone data without subtracting background noise, the application 40 controls circuitry in the telephone 24 to enable operation of the microphones and generate voltage signals indicative of the acoustic signals present at the telephone during time periods when the phone is not engaged in voice communications. Data received from one or more of the microphones are processed to determine, based on correlations, whether a gunfire event has occurred and whether the event was caused by the person in possession of the mobile telephone 24, e.g., a law enforcement officer. To this end, the acoustic voltage signals are compared to a reference value to determine if, at any time, the sound pressure level (spl) of the acoustic signal exceeds a predetermined threshold level, A. The threshold level, A, may be a threshold loudness level, e.g., in the range of 90-130 dB, which would normally be present when a gunshot is fired within about five meters from the telephone 24. The value of the reference voltage level is scaled to correspond to the loudness level, A.

As long as the spl remains below the threshold level A, the Subroutine 220 continues to serially process the microphone data, comparing the acquired levels of the acoustic voltage signal to the reference level to determine whether an event has occurred. When the level of the acoustic voltage signal exceeds the threshold level A, it is assumed that an event has occurred which may be a gun shot and the subroutine begins recording the acoustic voltage signals on a storage medium for analysis. In one embodiment, the acoustic voltage signals as continuously received from the microphone(s) are initially stored in a circular buffer (i.e., a memory which continuously receives data, overwriting the oldest data with new data) which is periodically overwritten. When criteria are met to initiate recording on the storage medium, data existing in the buffer (i.e., a series of measured acoustic voltage values acquired prior to the time when the event occurred) are transferred to the storage medium. The buffer contains adequate memory space to accommodate storage of data corresponding to a period, occurring prior to the detection, of sufficient length to capture useful information for analysis and determination of event attributes. With use of the buffer memory a relatively small amount of data can be temporarily stored corresponding, for example, to less than 0.5 sec of recordable sound. This assures preservation of limited acoustic information during a period preceding detection of the threshold level. Thus with use of a circular buffer a limited amount of data can be captured before occurrence of an event so that analysis and correlation of recorded sound is not only based on portions of a signal corresponding to decay of an impulsive signal. The data in the circular buffer can be transferred to the storage medium when additional data are to be recorded or, in the absence of an event, can simply be overwritten with new microphone data.

The beginning time of the recording written to the storage medium may be based on the portions of temporal data used in correlation analyses to draw inferences about the event. Generally, the acoustic voltage signals are recorded in memory or storage media of the telephone 24 at least during a period of time suitable for performing correlation analyses which confirm whether a gun shot has been fired, and which are determinative whether the gun shot was fired by the person possessing the telephone 24. Highest levels of confidence in determinations may be had by constructing recording periods which begin at times prior to occurrence of the acoustic event and extend through and after occurrence of the event. On the other hand, considerations of available buffer capacity and conservation of battery power may necessitate that recordings only include data obtained after the event is detected. The total recording time for such an acoustic event may exceed three to five seconds per event in order, for example, to capture repeated gun fire without experiencing a discontinuity in the recording.

According to an embodiment of the invention, inertial motion is monitored to facilitate determination of whether a gun shot event has occurred and whether the gun shot was fired by the person possessing the hand-held device. During at least a portion of the period in which the acoustic voltage signals are recorded, the hand-held device also records inertial motion data, e.g., as may be acquired with accelerometers based on movement of the hand-held device. The period during which inertial motion data is acquired may be coincident with the period of recording of the acoustic voltage signals in order to optimally perform time series correlation analyses. If the acoustic recording includes microphone data acquired prior to detecting a voltage level exceeding the threshold value A (e.g., either by continuous recording of microphone data into storage or with use of a circular buffer), accelerometer data may also be so acquired, e.g., stored in a circular buffer for possible later analysis. That is, the telephone may include sufficient buffer memory to acquire and preserve accelerometer data which was generated prior to and at the time the level of acoustic voltage signal was found to exceed the threshold level A. Accordingly, accelerometer data may be preserved simultaneously with acoustic data to perform correlations which result in reliable determinations as to (i) whether the event was a gun shot and (ii) whether a gun shot was fired by the person having possession of the telephone or other hand-held device at the time of the event. Decisions of when and how to record the data can influence reliability of determinations made, for example, based on correlations. There may be trade-offs between confidence levels and power consumption. Although correlation analyses may be preferred methods of making determinations, other methods may be utilized which detect known characteristics of gunshot events, or which screen events by a process of elimination. For example, if a signal is found to exceed the threshold level, A, but contains periodic information uncharacteristic of weapon fire, the event may still be reported to the application 42 running on the server, but identified as not being the result of weapon fire. Also, if the event is accompanied by accelerometer data uncharacteristic of weapon fire (e.g., if the acoustic signal is preceded by a large amplitude ground vibration signal) the event may still be reported but identified as not being the result of weapon fire.

When the law enforcement organization provides multiple officers with hand-held communications devices programmed to monitor gun fire, several of the devices may be used to detect and report distant gun fire, e.g., gun fire which is relatively distant from one hand-held device which has identified and reported a signal exceeding the threshold level, A. The distant gun fire may be identified based on a combination of (i) analysis of measured microphone voltage levels which do not exceed the threshold value A, and (ii) correlation or other detection techniques which reliably determine that such events are likely to be weapon fire. The application 40 can automatically report events of distant gun fire to the server 10 for use in further analysis to improve the confidence level of results reported by the one hand-held device which detected the weapon fire at a close distance (i.e., for which measured microphone voltage levels exceeded the threshold value A). If the hand-held device stores microphone data for limited periods (e.g., up to thirty seconds) the server can send requests out for potential gun shot information occurring in that limited period. The server may provide a desk officer in the law enforcement operation with a list identifying by name the nearby officers in possession of the hand-held devices which have reported the distant gunfire temporally coincident with detection of weapon fire at a close distance from the one hand-held device which has reported a signal exceeding the threshold level, A. The desk officer may then dispatch the nearby officers to the location of the event.

Figure 3A:
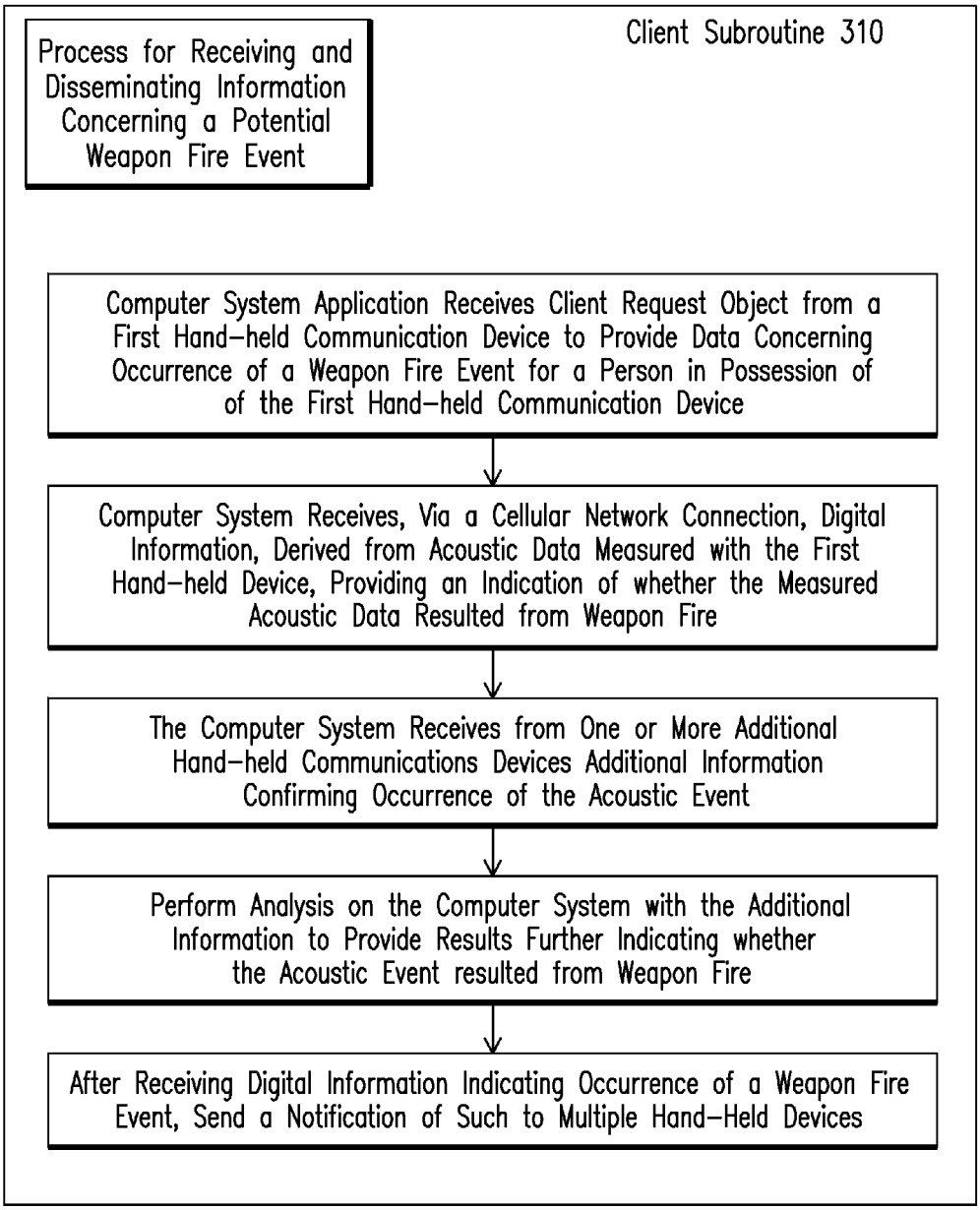
FIG. 3A illustrates a subroutine implemented on a server for receiving and disseminating information concerning a potential or determined weapon fire event.
Figure 3B:
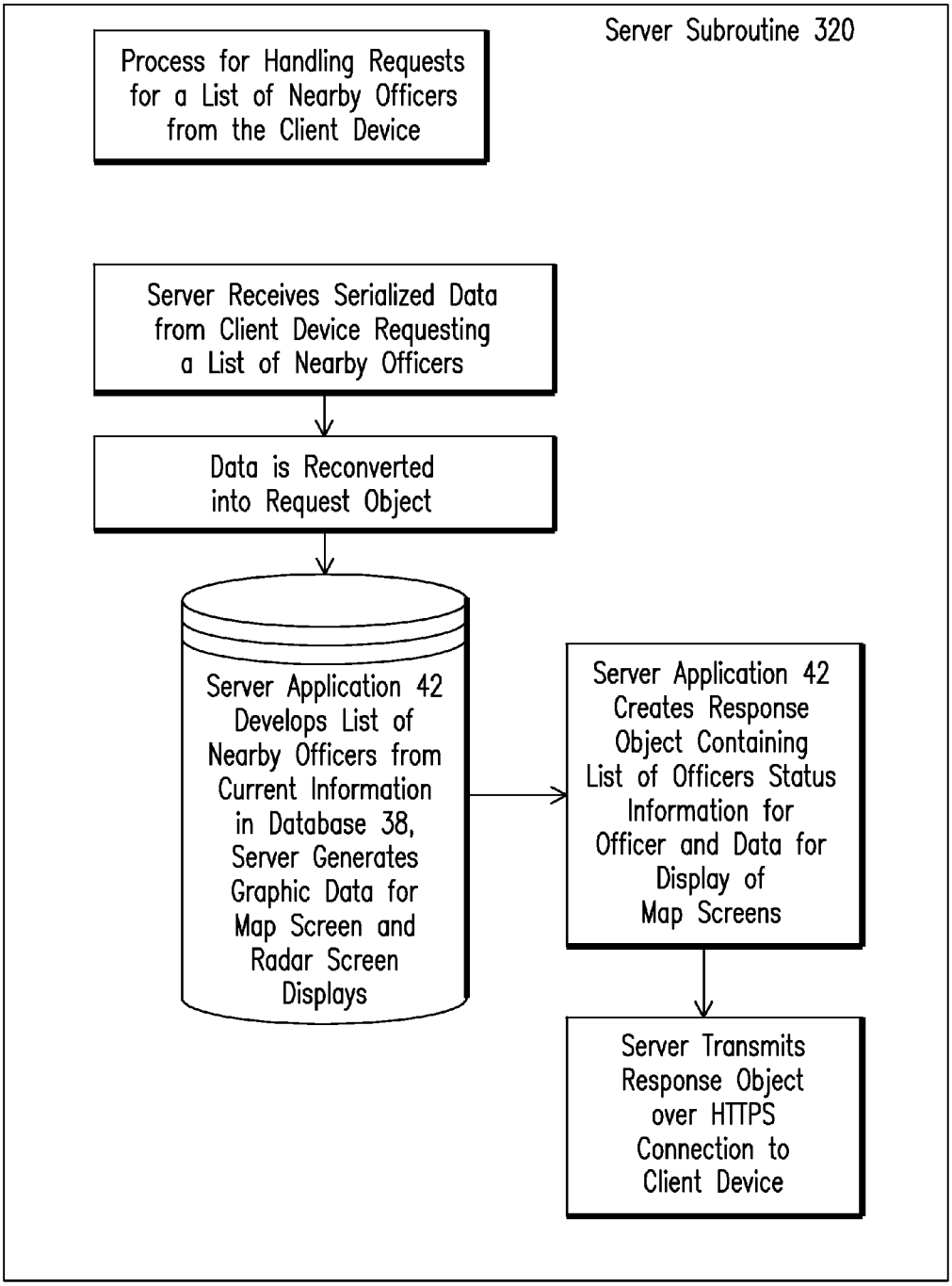
FIG. 3B illustrates a subroutine implemented on a server in which the server receives and responds to a request from one of multiple client devices for a most current list of nearby officers and associated graphic display data.

FIG. 3A illustrates a process implemented on the server 10 by the application 42 for receiving and disseminating information concerning a potential or determined weapon fire event. The server application 42 receives a Client Request Object from a first hand-held communication device which detects an acoustic event in order to (i) provide notification to the server 10 that a determination based on established criteria has been made, indicating that a detected acoustic event was the result of weapon fire, or (ii) provide information, e.g., correlation data, which can be compared to criteria present in the data base 38 of the server, to make a determination of whether the acoustic event resulted from a weapon fire. Similarly, the server application 42 may receive from the same or a different Client Request Object from the first hand-held device (i) a notification that the weapon fire event was caused by a person in possession of the first hand-held communication device, or (ii) information, e.g., correlation data, which the application 42 can compare to criteria present in the data base 38 in order for the server to make a determination of whether the weapon fire event was caused by the person in possession of the first hand-held communication device.

Once the computer system receives, via the cellular network connection, digital information, providing an indication of whether the measured acoustic data resulted from weapon fire, the server may also receive from one or more additional hand-held communications devices additional information confirming occurrence of the acoustic event. The server may then perform additional analysis to provide results which may further indicate whether or not the acoustic event resulted from weapon fire, or to confirm location of the weapon fire. Based on the information received and any analysis performed by the server, the server sends notification of information concerning the determined gun fire event to multiple hand-held devices.

Figure 2C:
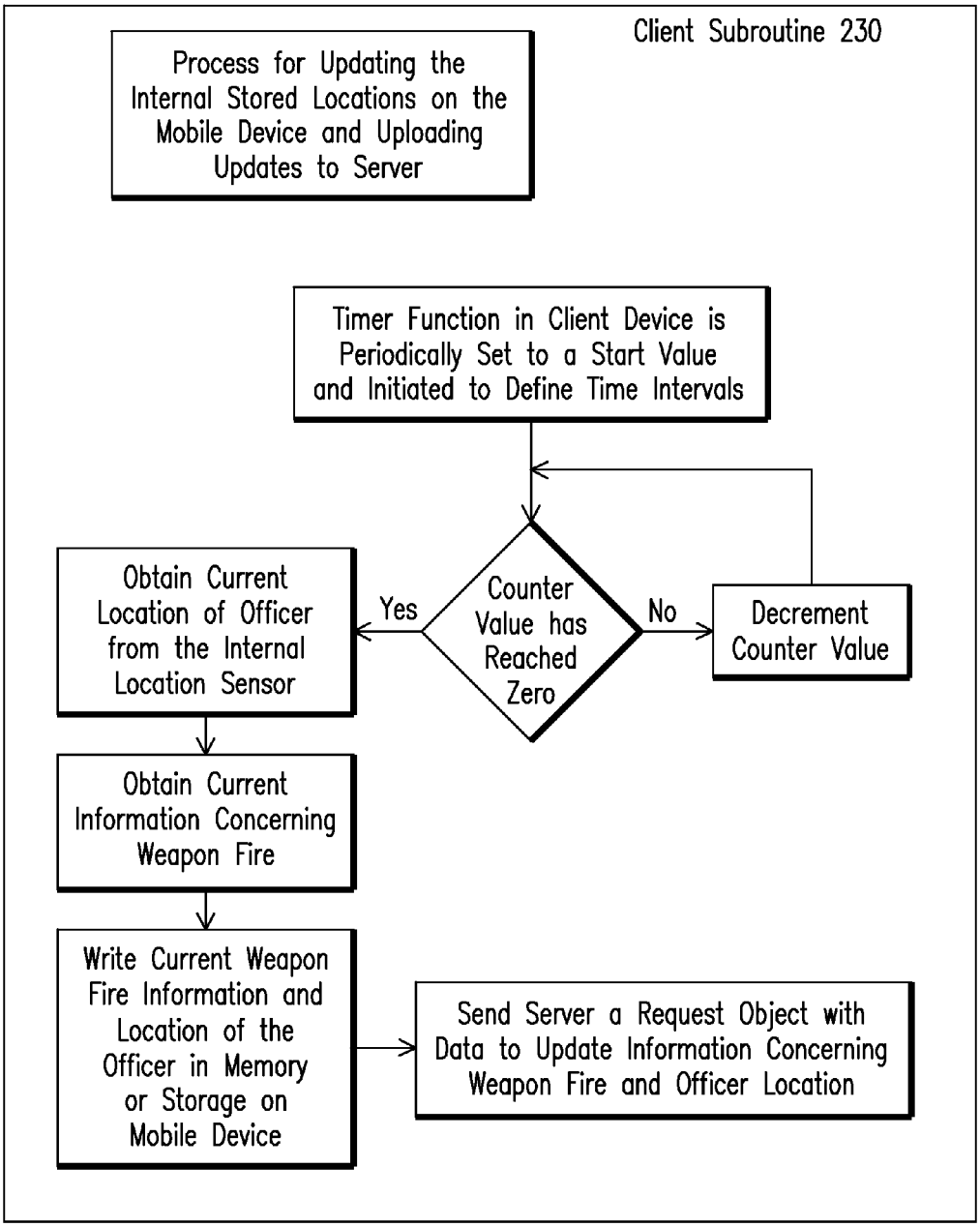
FIG. 2C illustrates timer function subroutine used to periodically acquire the physical location information and provide updated reports to a server regarding weapon fire.

With reference to FIG. 2C the client subroutine 230 utilizes a timer function (i) to periodically acquire the physical location of the officer based on, for example, GPS data acquired by the client device, and (ii) to periodically provide updated reports to the server regarding weapon fire. For example, with the counter set to a start value determinative of a predefined time interval (e.g., five to sixty seconds) updates to the location of the officer are periodically written to memory or storage in the client device. Also, on each occasion the counter value reaches zero, periodically updated information stored in the client device is available for access in order to routinely send current available information regarding weapon fire and officer location to the server.

At least whenever a gunshot event is detected, the client subroutine 230 sends updates to the server 10 regarding the officer location and other status information of the officer in possession of the device which detects the gunshot event. That is, request objects can be automatically and periodically populated based on most recent updates to information stored in the client device. Alternately, each time the timer value is decremented to zero, the client device may send the officer location and link status to the server 10. The received information is used as an update to the officer's status and location information stored in the server data base 38. Each update may provide the same status information as an immediately preceding update or may provide changes to the status information.

In the foregoing example, the client device provides updated information to the server. This may be effected with a component software module of the client application 40, referred to as the Adjacent Officer Manager Service, running in the background of the client device. The Adjacent Officer Manager Service periodically sends to the server, or acquires from the server, updates of information. When providing information to the server, such as an update to the officer's current location, the client device generates a Java request object, adds the current officer location information to the object, serializes the request object (i.e., the request object undergoes Java object serialization) and sends it to the server. Upon receipt, the server deserializes the data and updates the data base 38 accordingly. The server then sends an empty Java response object to the client device. Upon receipt of the response object the client device closes the HTTP connection with the server.

The Adjacent Officer Manager Service periodically requests updates for a list of nearby officer information for display on the client device. The requested updates are based on information periodically received by the server from each officer logged into the server application 42. In order for the client device to obtain a list of nearby officers from the server, the client device generates a Java request object (i.e., that the server provide the list), serializes it and sends it to the server. Upon receipt, the server deserializes the request object and queries the database to identify nearby officers (according to specified criteria such as distance from the client device making the request). The server then builds a Java response object, populates it with location data and information relating to weapon fire, serializes it and sends the response object to the client device which generated the request object. The client device deserializes the response object, closes the HTTP connection and processes the list of officers, e.g., to generate and display a list or a map of officer locations.

Figure 2D:
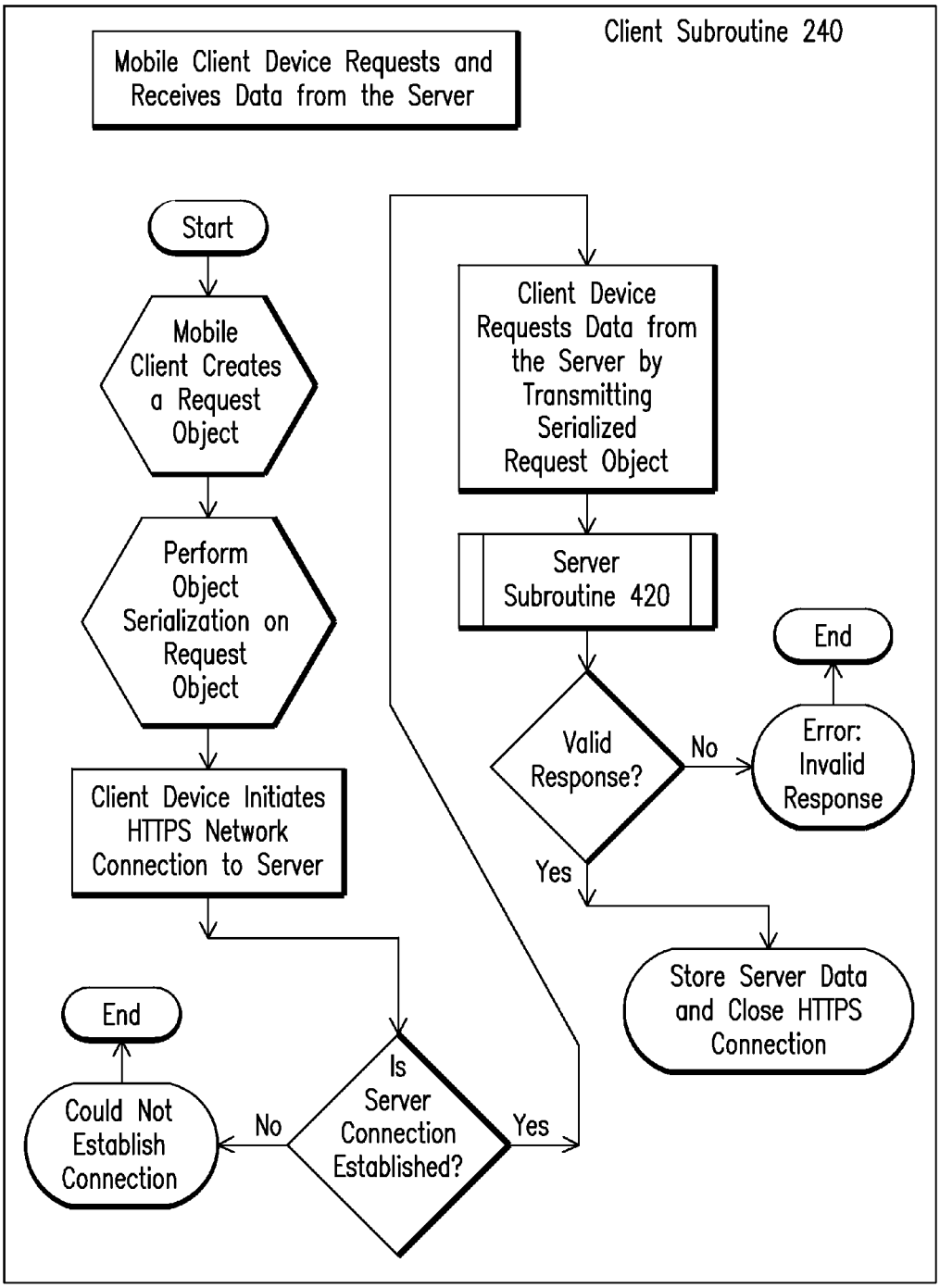
FIG. 2D illustrates a subroutine in which a client device initiates data requests and receives data from a server.

The client subroutine 240 of FIG. 2D illustrates a generic process in which the client device initiates data requests and receives data from the server. The request object is serialized, e.g., undergoes Java object serialization, and is assembled in memory as a data sequence or is stored as a file descriptive of the object and object type. Object serialization converts the message request so that it can be transmitted through an open network socket created by the client device and across the network 10 to the server 12 for receipt in the application 34. See, also, FIG. 3B in which the server subroutine 320 receives and responds to a request from one of multiple client devices for a most current list of nearby officers and associated graphic display data. When the mobile client devices request updated lists of nearby officers from the server, the information is used to update maps on the mobile devices, displayed lists of officers, and other components of the server application 42 which utilize this information. This allows the mobile client devices to display timely information relevant to weapon fire, including officer locations. Any client screens that display a list or map of other officers can be updated to display such officers in an identifiable way.

Multiple embodiments of methods for detecting near range weapon fire have been described. By near range it is meant that the source of the weapon fire may be positioned within ten to forty meters of a hand-held device when the weapon firing is detected. In some embodiments the distance between the hand-held device and the weapon may be five meters or less, but it is possible for the method to provide reliable detections when the distance is much greater, e.g., substantially more than forty meters.

Although the invention has been described with reference to specific embodiments, the invention is not limited to these examples but, rather, is only limited by the scope of the claims which follow.

The invention claimed is:

1. A method of detecting weapon fire with a hand-held device of the type having a microphone capable of detecting acoustic energy present at the hand-held device, the hand-held device including capability of recording acoustic energy detected by the microphone, comprising:

using the microphone to continually generate a time series of acoustic voltage signals indicative of temporally varying sound pressure levels at the hand-held device;

analyzing the acoustic voltage signals to identify an event for which voltage for the sound pressure level exceeds a predetermined threshold value corresponding to an acoustic energy level that limits identification of gunshot occurrences to weapon firings which occur within a predeterminable distance from the hand-held device;

for an identified event, recording the acoustic voltage signals received from the microphone during a first time period on a non-transitory computer readable storage medium;

determining one or more correlations in a first set, each correlations being between characteristics of the recorded acoustic voltage signals and a prior known information characteristic of a gun fire event; and determining whether the event is a gun fire event based on whether, for at least one type of correlation in the first set, the determined correlation meets or exceeds a threshold correlation value assigned to the correlation type.

2. The method of claim 1 further including acquiring accelerometer data based on movement of the hand-held device during a second time period coincident with recording of the acoustic voltage signals and after it is determined that a voltage for the sound pressure level exceeds the predetermined threshold value.

3. The method of claim 1 wherein, when at least one of the correlations in the first set exceeds the associated threshold correlation value, the method including sending information to a processor via the network to indicate an occurrence of gun fire.

4. The method of claim 1 further including determining a second set of correlations between acoustic voltage signals and acquired accelerometer data wherein a threshold correlation value is associated with each correlation in the second set.

5. The method of claim 4 wherein, when at least one of the correlations of the second set exceeds the associated threshold correlation value, the method including sending information via the network that the weapon which created the gun fire occurrence was fired by a person having possession of the hand-held device.

6. A method for identifying or analyzing signals to determine occurrences of gun fire, comprising:

acquiring time varying acoustic data with a microphone coupled to a hand-held device;

storing the acoustic data in a non-transitory computer readable storage medium;

providing information indicative of acoustic energy levels associated with the acquired data;

providing a signal strength criterion based on a predetermined threshold acoustic energy level;

providing criteria unique to weapon fire to establish that the acquired data is generated by weapon fire;

applying the signal strength criterion to determine whether the time varying data is based on a signal strength having a predetermined threshold acoustic energy level; and when it is determined that the time varying data is based on the predetermined threshold acoustic energy level, applying the weapon fire criteria to determine whether the acquired data is generated by weapon fire.

7. The method of claim 6 wherein the criteria unique to weapon fire are correlation criteria applied to determine whether the time varying data satisfies at least one of the correlation criteria.

8. The method of claim 6 wherein the predetermined threshold acoustic energy level is used to limit identification of gunshot occurrences to weapon firings which occur within a predetermined distance from the hand-held device.

9. A method of identifying a gunshot occurrence with a mobile hand-held device comprising the steps of:

acquiring microphone data with the hand-held device;

acquiring inertial motion data with the hand-held device during a portion of the time period in which the microphone data is acquired;

based on an acoustic criterion, determining whether a gunshot has been produced; and based on a correlation criterion applied to the inertial motion data, determining whether the gunshot was produced from gun fire by a first person having physical possession of the hand-held device or by a second person spaced away from the first person.

10. The method of claim 1 wherein:

when the determined correlation meets or exceeds the threshold correlation value, reporting a determination that the event was a gun fire event.

11. The method of claim 1 further including, when the event is determined to be a gun fire event: providing information based on the determination to a display screen to provide a notification based on the determination.

12. The method of claim 1 further including counting bullets fired by a person holding the hand-held device or counting bullets fired by one or more other persons.

13. The method of claim 12 wherein counting bullets is based on temporal correlations between the time series of acoustic voltage signals and accelerometer data.

14. The method of claim 1 wherein microphone data is processed to generate the acoustic voltage signals without subtracting background noise.

* * * * *